US010458324B2

(12) United States Patent
Edwards

(10) Patent No.: US 10,458,324 B2
(45) Date of Patent: Oct. 29, 2019

(54) ROTARY PISTON ENGINE

(71) Applicant: Daniel J Edwards, Savannah, GA (US)

(72) Inventor: Daniel J Edwards, Savannah, GA (US)

( * ) Notice: Subject to any disclaimer, the term of this patent is extended or adjusted under 35 U.S.C. 154(b) by 78 days.

(21) Appl. No.: 15/599,872

(22) Filed: May 19, 2017

(65) Prior Publication Data

US 2017/0356334 A1 Dec. 14, 2017

Related U.S. Application Data

(60) Provisional application No. 62/342,027, filed on May 26, 2016.

(51) Int. Cl.

| | |
|---|---|
| ***F02B 53/10*** | (2006.01) |
| ***F02B 53/12*** | (2006.01) |
| ***F02B 55/02*** | (2006.01) |
| ***F02B 55/08*** | (2006.01) |
| ***F02B 55/16*** | (2006.01) |
| ***F01B 3/00*** | (2006.01) |

(52) U.S. Cl.

CPC ..... *F02B 53/10* (2013.01); *F01B 3/0035* (2013.01); *F01B 3/0055* (2013.01); *F02B 53/12* (2013.01); *F02B 55/02* (2013.01); *F02B 55/08* (2013.01); *F02B 55/16* (2013.01); *F01B 3/0041* (2013.01)

(58) Field of Classification Search

CPC ..... F02B 53/10; F02B 53/12; F02B 55/02; F02B 55/08; F02B 55/16; F01B 3/0035; F01B 3/0055; F01B 3/0041

USPC ..... 123/205, 43 AA, 43 A, 56.8; 418/261, 418/264–265

See application file for complete search history.

(56) References Cited

U.S. PATENT DOCUMENTS

| | | | | |
|---|---|---|---|---|
| 1,048,308 A | | 12/1912 | Hendley | |
| 1,312,234 A | * | 8/1919 | Carlson | F02B 75/26 123/56.8 |
| 1,400,255 A | | 12/1921 | Anderson | |
| 1,569,525 A | * | 1/1926 | Owens | F01B 3/0032 123/43 A |
| 1,614,476 A | * | 1/1927 | Hutchinson | F01B 3/0032 123/43 AA |
| 1,762,650 A | * | 6/1930 | Boughton | F01B 3/04 123/56.8 |

(Continued)

FOREIGN PATENT DOCUMENTS

| | | | | |
|---|---|---|---|---|
| DE | 10133497 A1 | * | 1/2003 | F01B 3/0032 |
| EP | 0137621 A1 | * | 4/1985 | F01B 3/04 |

(Continued)

*Primary Examiner* — Thai Ba Trieu

(74) *Attorney, Agent, or Firm* — Hanes & Bartels LLC

(57) ABSTRACT

A rotary piston engine having a rotor with an output shaft and a plurality of longitudinally extending cylinder-forming bores, each having a slidable piston disposed therein. The rotor is contained in a housing that contains an elliptical cam track that interacts with the pistons, upon combustion, to cause rotation of the rotor. An opening in the housing end cap admits air into the cylinders on the rear side of the pistons and a port delivers air driven by the rear side of the pistons to an intake port in the side of the housing where, in response to the angular position of the rotor, the air is admitted to the front side of a piston for compression with injected fuel. The compressed fuel-air mixture is ignited and an exhaust port in the side of the housing opens to discharge the products of combustion.

9 Claims, 14 Drawing Sheets

(56) References Cited

U.S. PATENT DOCUMENTS

| | | | | | |
|---|---|---|---|---|---|
| 2,227,853 | A * | 1/1941 | Turner | F02B 75/28 | 123/51 BA |
| 2,949,100 | A * | 8/1960 | Petersen | F01B 3/0032 | 123/43 AA |
| 2,983,264 | A * | 5/1961 | Herrmann | F02B 75/26 | 123/56.8 |
| 2,988,065 | A | 6/1961 | Wankel | | |
| 3,068,709 | A * | 12/1962 | Petersen | F01B 3/0032 | 123/43 AA |
| 3,373,723 | A | 3/1968 | Blosser | | |
| 3,405,641 | A * | 10/1968 | Coberly | F01B 3/0032 | 417/271 |
| 3,438,358 | A | 4/1969 | Blosser | | |
| 3,793,998 | A | 2/1974 | Yokoi | | |
| 4,022,167 | A * | 5/1977 | Kristiansen | F02B 75/26 | 123/43 AA |
| 4,287,858 | A * | 9/1981 | Anzalone | F02B 75/26 | 123/43 AA |
| 5,016,580 | A * | 5/1991 | Gassman | F02B 75/26 | 123/56.8 |
| 5,209,190 | A * | 5/1993 | Paul | F02B 75/28 | 123/43 AA |
| 5,261,365 | A | 11/1993 | Edwards | | |
| 5,345,905 | A | 9/1994 | Edwards | | |
| 6,601,547 | B2 * | 8/2003 | Al-Hawaj | F02B 75/26 | 123/43 AA |
| 6,601,548 | B2 * | 8/2003 | Al-Hawaj | F02B 75/26 | 123/43 AA |
| 6,986,328 | B2 * | 1/2006 | Huettlin | F01B 3/0035 | 123/43 AA |
| 7,721,685 | B2 * | 5/2010 | Page | F02B 53/02 | 123/43 A |
| 2010/0236522 | A1 * | 9/2010 | Page | F02B 53/02 | 123/43 AA |

FOREIGN PATENT DOCUMENTS

| | | | | |
|---|---|---|---|---|
| GB | 362721 | A * | 12/1931 | F01B 3/0032 |
| WO | WO-9514156 | A1 * | 5/1995 | F01B 3/0032 |

* cited by examiner

Left Side-
Three positions
in compression cycle

Right Side-
Three positions
in the intake cycle

ROTARY PISTON ENGINE

Pursuant to the provisions of 35 U.S.C. § 119(e), this application claims the benefit of a U.S. provisional application filed pursuant to 35 U.S.C. § 111(a) by the same inventor entitled Rotary Piston Engine, filed May 26, 2016, application No. 62/342,027.

The present invention relates generally to internal combustion engines and more specifically to one having multiple pistons in a rotating rotor.

BACKGROUND OF THE INVENTION

Rotary engines with pistons mounted in a rotating rotor have been in the engine art for some time. See for example, the G. E. Henley, U.S. Pat. No. 1,048,308, and the H. Q. Anderson, U.S. Pat. No. 1,400,255. Through the years the other patents were issued on improvements and changes to the original rotary concept, the most notable of which was the Felix Wankel, U.S. Pat. No. 2,988,065. Other less notorious patents on the subject have been issued, including D. N. Blosser, U.S. Pat. Nos. 3,438,358 and 3,373,723, M. Yokoi et al, U.S. Pat. Nos. 3,793,998 and 5,261,365 and 5,345,905 to Daniel J Edwards.

The most pertinent prior art patents from the standpoint of the present invention are U.S. Pat. No. 7,219,633 to Robert A. McLeod, and U.S. Pat. No. 5,890,462 to Wiamir A, Bassett which describe engines using a process or a method similar to the present invention. In their disclosures both Bassett and McLeod recognize the advantage of using a cam or swash plate operably connected with a follower to create collapsible cylinders within a rotor. The piston is moved by the cam or swash plate to inhale and compress air which can then be compressed into a cylinder, fired and used in a combustion cycle. Both of these designs require a traditional four stoke cycle where air is drawn into the compression device on one downward stroke and air is compressed above the piston on one upward stroke of the piston. Both of the prior engines require several moving parts and complete their given combustion cycles within the compression cylinder created by the pistons and collapsible cylinders.

Accordingly, it is the primary object of the present invention to provide an engine system that is smaller, simpler to build, more durable, more efficient and capable of greater torque and power output, size for size, than any other rotary or reciprocating engine of the prior art.

Another object of the invention is to provide an engine that can inhale, compress and combust large amounts of air with a simple modified two stroke combustion process that will provide momentum, tangent energy and leverage in the combustion cycle to produce more power with greater efficiency then the traditional four stroke piston engine.

Another object of the present invention is to provide a rotary engine having exceptionally good characteristics for purging exhaust gases from the engine without the use of a poppet valve or poppet valve system.

Yet another and further object of the present invention is to provide an engine that uses a combination of rotary motion and the concurrent sliding of pistons together with a novel shape of the pistons to open and close rotary ports on the intake cycle so that the traditional reed valve system associated with the normal two stroke engine is eliminated, increasing volumetric efficiency without the use of reed valves or associated parts.

Additional objects, features and advantages of the present invention will become apparent upon a reading of the following description of a preferred form of the invention.

SUMMARY OF THE INVENTION

The rotary engine of the present invention includes a cylindrical rotor having a plurality of longitudinally extending cylinder-forming bores, each having a sliclable piston disposed therein for simultaneously compressing and inhaling air at the same time, that is, inhaling air on one side of a piston while simultaneously compressing air on the other side of the piston. Each of the pistons are provided with a protruding pin that extends into a fixed elliptically shaped cam track on the interior cylindrical wall of a housing that encircles the rotor. During the combustion cycle of each piston the piston is moved longitudinally in its cylinder. As the piston moves along the cylinder its protruding pin follows the cam track causing the rotor to rotate on a power shaft that extends axially through the rotor and is journaled in the end caps of the rotor housing. While one piston is in its combustion cycle providing the power to turn the rotor, the protruding pins of other pistons are also engaging the cam track causing the pistons to which they are connected to slide back and forth within the rotor creating collapsible compression cylinders on both sides of the piston as the rotor turns within the rotor housing.

Also provided in the engine is a simple transfer port, whose function relies on the rotary motion of the rotor and the position of the sliding pistons, that allows a piston on the compression cycle to transfer compressed air from the back compression side of the rotor into the front compression and combustion cylinder while the piston is in the exhaust cycle. An overlap in the transfer allows the compressed transferring air to assist in pushing out the products of combustion and then closes to allow a transfer of fresh air or air/fuel mixture into the front or combustion side of the compression cylinder. When a piston reaches top dead center on the combustion half of its cycle that piston has compressed an air/fuel mixture and is ready to fire and begin a combustion cycle in the traditional manner. The rear portion of this same piston has completed an intake cycle and has closed the fixed intake port via rotary motion. As the piston fires and begins its combustion cycle the rear side of the same piston begins a compression cycle. As the piston completes the combustion cycle it comes into communication with a fixed exhaust port in the rotor housing allowing the products of the combustion process to escape from the front compression cylinder.

Locating the fixed cam track in the rotor housing produces more applied leverage in the compression and combustion process and allows a longer combustion cycle.

DESCRIPTION OF THE DRAWINGS

FIGS. 8*a*-11*a* are diagrammatic top views of the rotor housing with front and rear end caps showing the position of the single piston of FIGS. 8-11 within the piston's cylinder and showing the rotary position of the piston cylinder during the combustion cycle.

FIGS. 12*a*-15*a* are diagrammatic top views of the rotor housing with front and rear end caps showing the position of pistons 1 and 2 of FIGS. 12-15 within the piston's cylinder and showing the rotary position of the piston cylinder during the period of rotor rotation from 270 to 90 degrees.

DETAILED DESCRIPTION OF A PREFERRED EMBODIMENT

Figure 1:
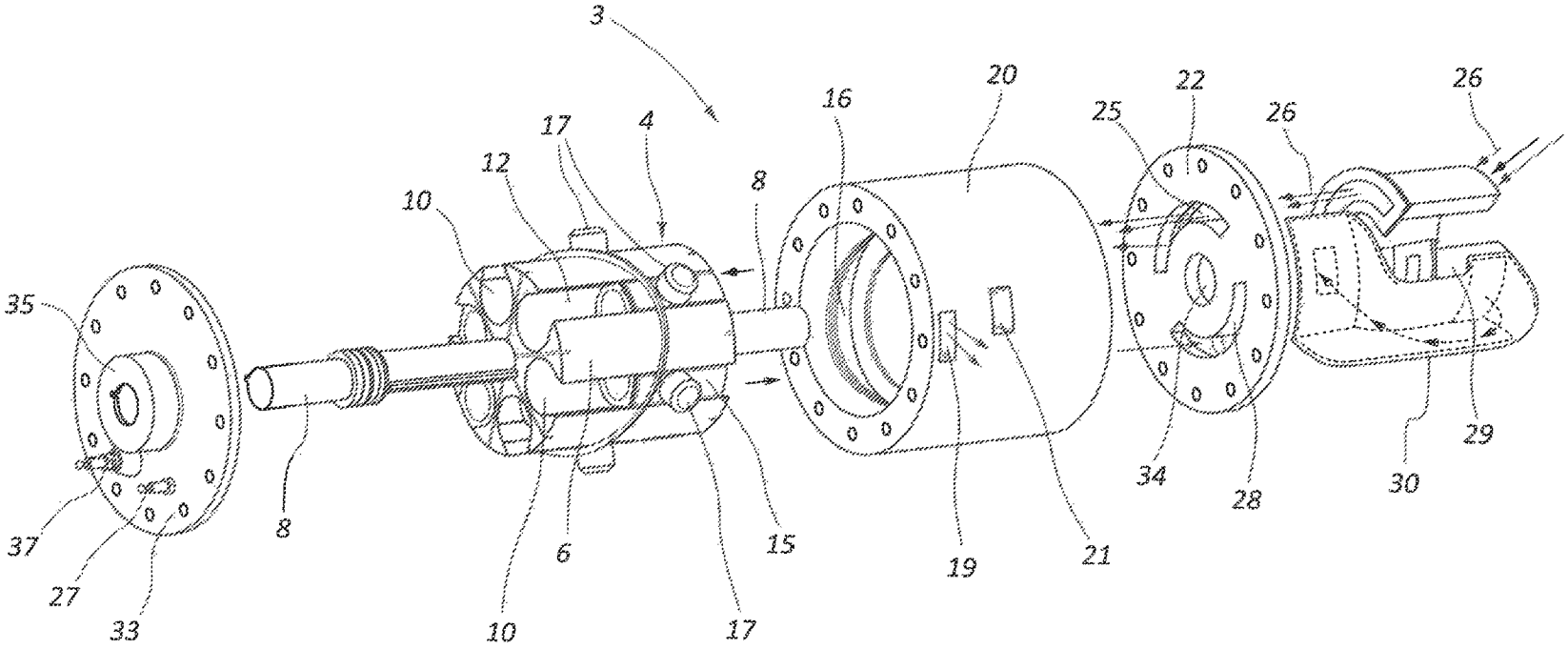
FIG. 1 is an exploded perspective view of the engine of the present invention.
Figure 1A:
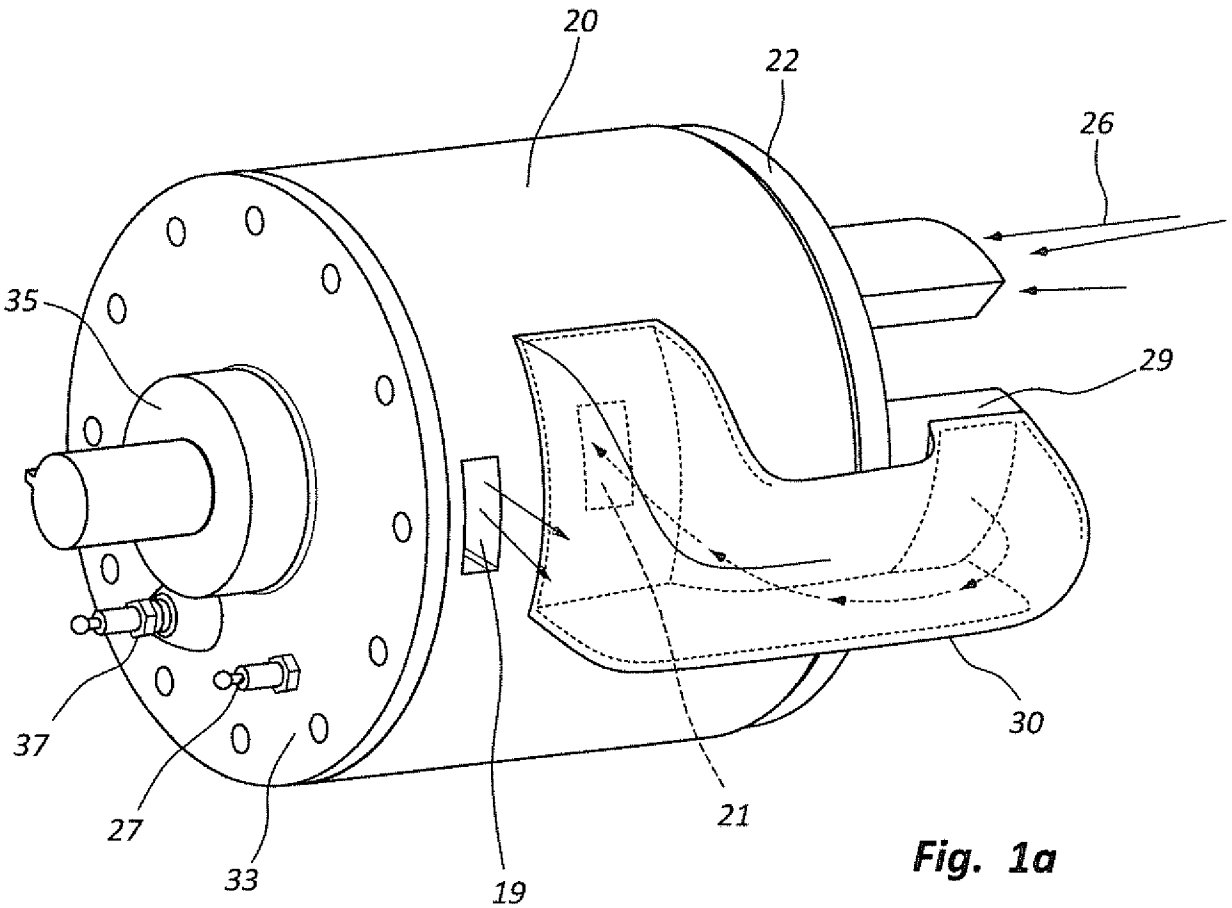
FIG. 1*a* is a perspective view of the intake manifold and manifold that transfers air from the compressed air slot on the rear end cap into the air intake port in the side of the housing.
Figure 2:
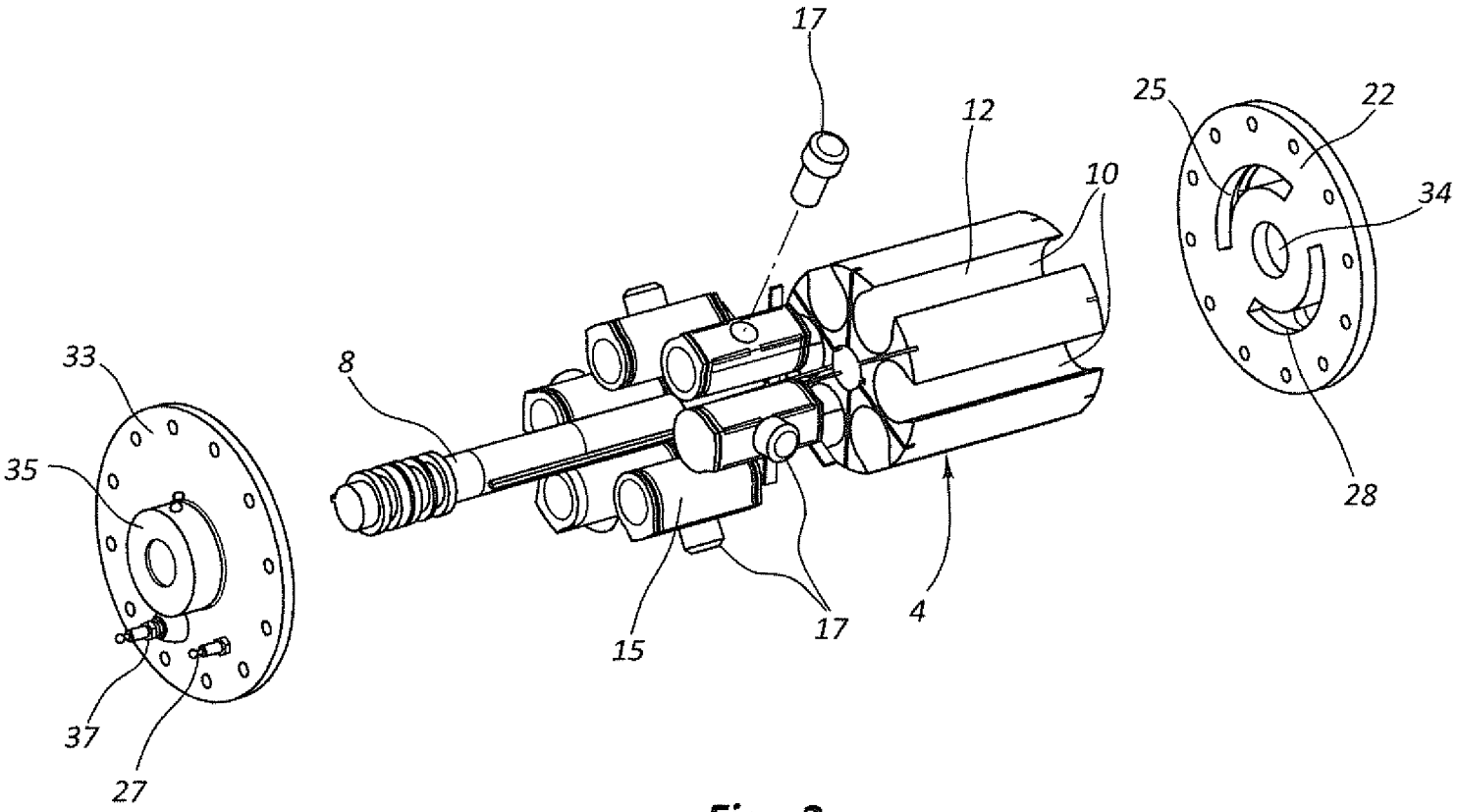
FIG. 2 is an exploded perspective view of the engine with the pistons shown outside of the piston cylinders to illustrate the piston construction in more detail.
Figure 4:
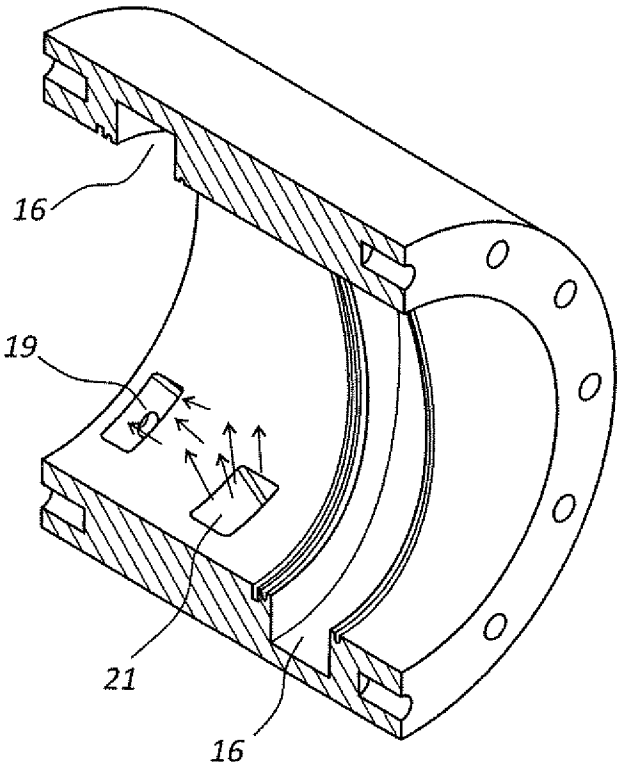
FIG. 4 is a longitudinal cross sectional view of the rotor housing.
Figure 3:
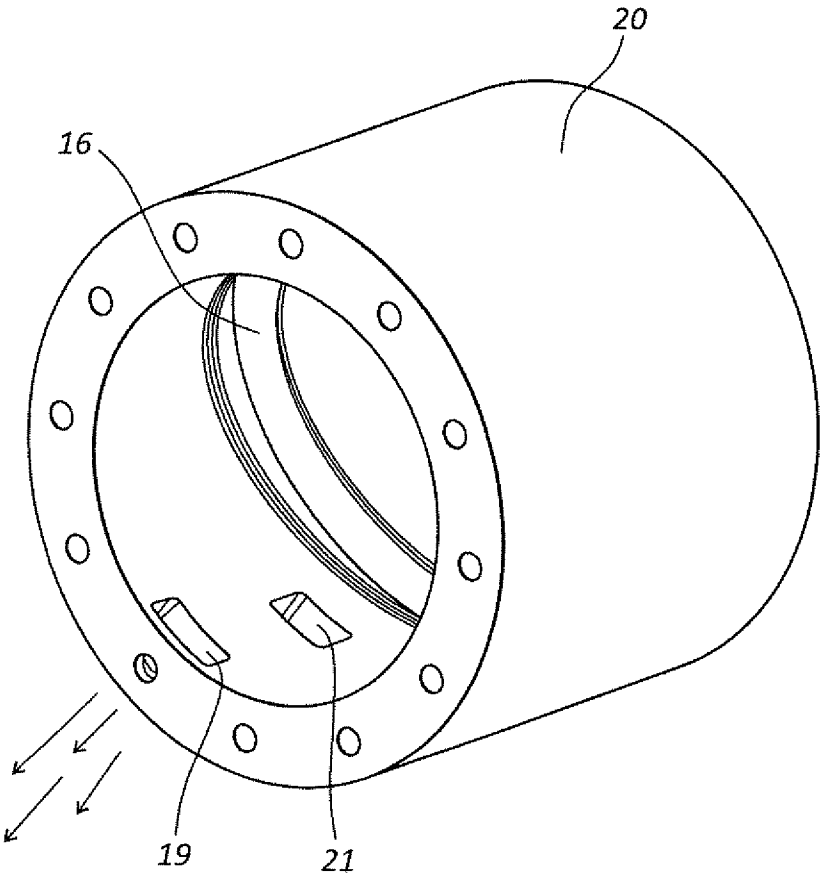
FIG. 3 is a perspective view of the rotor housing.
Figure 5:
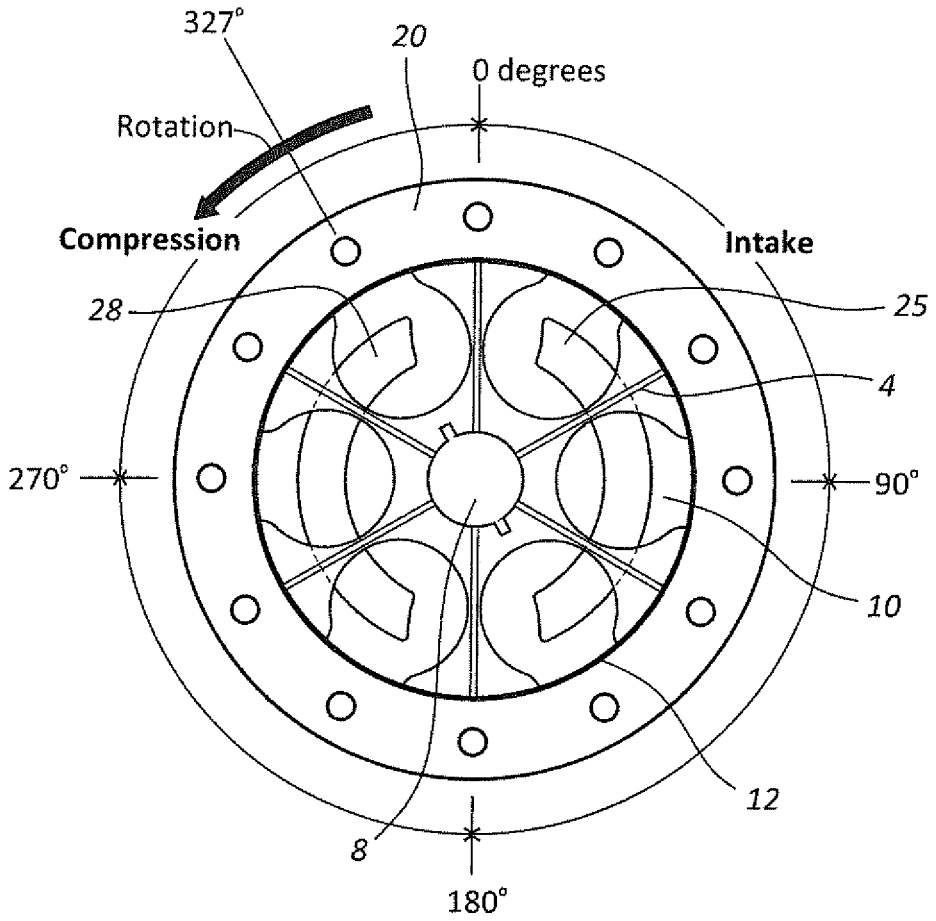
FIG. 5 is an end view of a six cylinder rotor inside of the housing where the rotor cylinders are shown without pistons to reveal the rear end cap of the engine housing.

As seen in FIGS. 1 and 2, the rotary engine 3 of the present invention comprises a cylindrical rotor 4 having an outer surface 6, an elongated drive shaft 8 and a plurality of longitudinal cylindrical bores spaced around the circumference of the rotor and forming piston cylinders 10 whose radii extend beyond the perimeter of the rotor forming longitudinal slots 12 therein. A like plurality of pistons 15 are slidingly disposed in the piston cylinders, each of the pistons having a follower pin 17 that extends through a respective slot 12.

The rotor 4 is rotatably disposed within a housing 20 having a cylindrical inner surface which is relieved along an elliptical endless channel to form a cam track 16 to receive and engage the respective piston follower pins 17. An exhaust port 19 in the side of the housing serves to release the products of combustion from the front compression cylinders.

Figure 6:
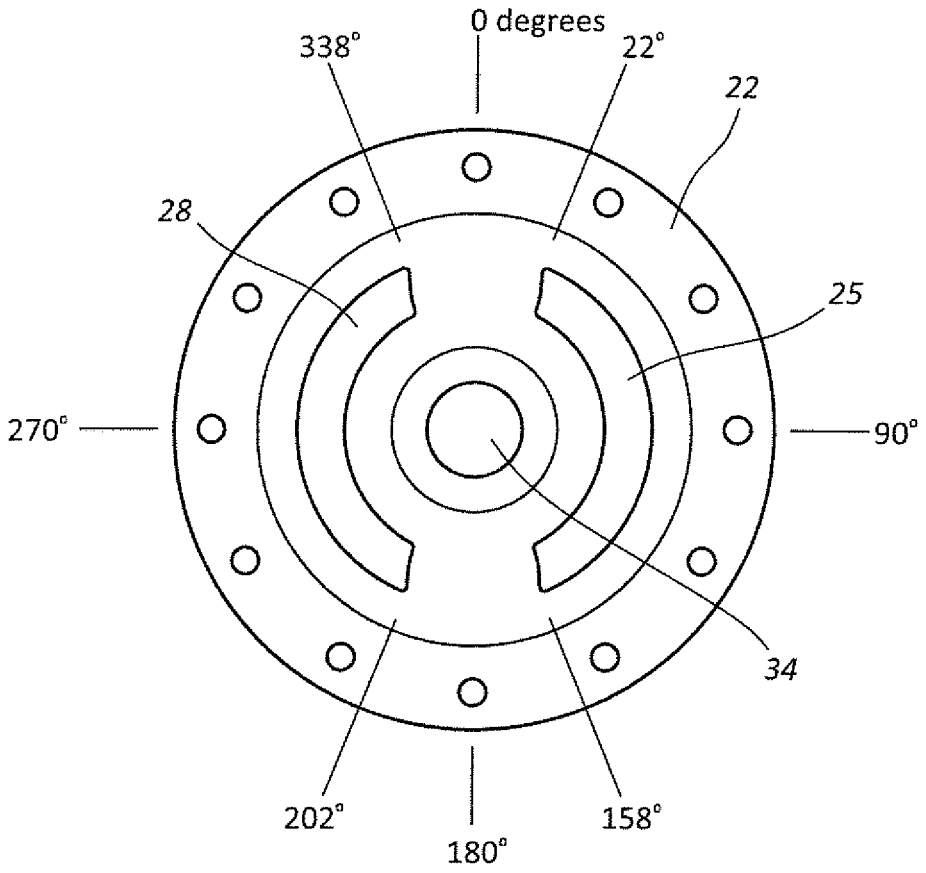
FIG. 6 is a front view of the rear end cap of the rotor housing illustrating the location in degrees of the compression and intake ports
Figure 7:
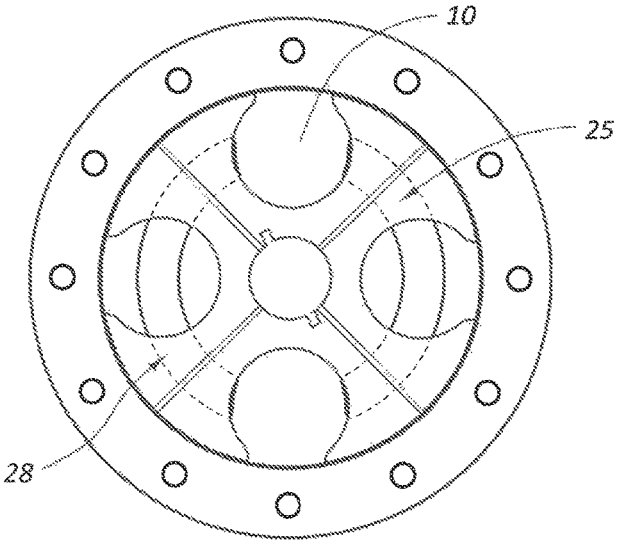
FIG. 7 is a front view of a four piston rotor inserted in the rotor housing.

A rear end cap 22 is attached by bolts or similar devices to the rear side of the housing 20. As shown in FIG. 6, where the top of the end cap shall be designated as 0 degrees, the end cap is provided with an arcuate slot 28 which extends from about 338 degrees to 200 degrees for the discharge of the air that is compressed by the pistons within the cylinders 10. Diametrically opposite to the compressed air slot 28 is an arcuate slot 25 extending from 158 degrees to 22 degrees for admitting ambient intake air 26 into the cylinders 10 of the rotor. Attached to the outside of the rear end plate and covering the compressed air slot 28 is a manifold 29 that directs the compressed air into the transfer manifold 30 which conveys the compressed air into the intake/transfer port 21 in the side of the housing 20. Disposed at the center of the end cap 22 is an aperture and included bearing 34 for supporting the rear end of the drive shaft 8.

Closing the front end of the housing 20 is a front end cap 33 which is bolted or similarly attached to the front of the housing. The center of the front end cap contains an aperture and included bearing 35 for journaling the front end of the drive shaft 8. A spark plug 37 is carried by the front end plate and extends through the plate to expose the spark plug gap to the front of a cylinder 10 as it passes the spark plug in the rotation of the rotor. The spark plug is located at top dead center or the 0 degrees point of the engine, the angular orientation being based on the positions of the slots 25 and 28 as seen in FIG. 6. In FIGS. 1 and 2 the position of the spark plug at 0 degrees is not at the top of the end cap because the exploded view of the components of the engine in those figures have been rotated to illustrate the intake/transfer port 21 and the exhaust port 19 in the housing 20. Although a fuel injector 27 can be located in several places, the preferred position is in the front end cap, as shown in FIG. 15*a* where fuel can be directly injected into the compression end of the cylinder. Using this method of direct injection the injector is not subject to combustion pressures and there is no loss of fuel/air mixture during the exhaust cycle that occurs in the traditional two stroke cycle.

The preferred form of the engine shown in FIGS. 1 and 2 contains six cylinders 10 and six pistons 15 however the invention is not limited to six. There may be more or less than six. Similarly, the degreed opening and closing, size and dimension of the exhaust port 19 and the intake/transfer port 21 will be made to accommodate the number of cylinders and the size of the rotor.

The fundamental concept of the engine's operation is a simple two stroke process with the front sides of the engine's pistons 15 completing a combustion cycle while the back side of the pistons are completing an intake, compression and transfer of compressed air into the front side of the engine. Once the combustion process begins three pistons in front half of the engine are in some phase of the 180 degree combustion cycle. Combustion causes the pistons to move longitudinally in their respective cylinders 10 causing followers 17 to interact with the fixed cam track 16 in the rotor housing 20 using the applied leverage to turn the rotor counter clockwise within the rotor housing. During the combustion cycle of the cylinders on the front side of the pistons, the cylinders 10 on the rear side of the pistons are in a compression cycle and in communication with the compression port 28. The air is compressed in the rear portion of the cylinders and ducted out of the cylinders through the transfer manifold 30 and introduced into the cylinder in front of a piston at properly timed intervals (between 180 and 0 degrees). Once the front compression cylinders complete their combustion process and reach bottom dead center (180 degrees) the rear portion of the cylinders comes into communication with the air intake port 25 on the rear end cap 22 and the rear compression cylinders begin an intake cycle inhaling ambient air which fills the space in the cylinders at the rear of the pistons while the front side of the pistons receive an intake of air from the transfer manifold to begin the compression cycle between 180 and 0 degrees. When the front of a piston reaches its top dead center position at 0 degrees the compressed fuel-air mixture is ignited and that piston's combustion/compression cycle begins with combustion occurring in front of the piston and compression occurring in the rear of the same piston. This arrangement of pistons and cylinders permits a longer two stroke combustion process and when used with a direct injection system placed in the front cap there is no loss of combustible fuel in the exhaust cycle.

The operation of the engine is further illustrated in diagrammatic FIGS. 7-15 and 8*a*-15*a* which are quasi cross sectional views of the housing, rotor, pistons, and intake/transfer port 21 and exhaust gas port 19. The ambient air intake slot 25 and the slot 28 for discharging air compressed by the rearward movement of the pistons that are disposed in the housing's rear end cap are also shown. A four cylinder rotor 4A is illustrated to simplify the explanation. FIGS. 8-11 trace the operation and function of a single piston, No. 1, through its combustion cycle. FIGS. 12-15 are similar to FIGS. 8-11 to illustrate the working of the air intake/transfer port 21 and the exhaust port 19 as a function of rotor and cylinder position. In addition to piston No. 1, FIGS. 12-15 depict a second piston, No. 2, as an example of the interaction between adjacent pistons and cylinders. FIGS. 8*a*-15*a* are diagrammatic views from the top of the housing 20 showing the rear end cap 22 with the air transfer manifold 30 and the ambient air intake port 25.

Figure 8:
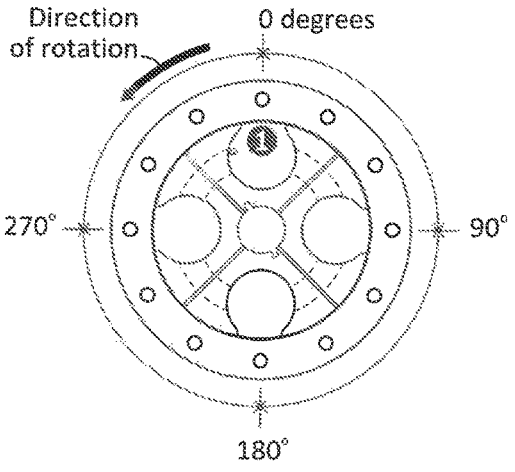
FIGS. 8-11 are diagrammatic front views of the four piston rotor of FIG. 7, tracing the position of a single piston (shown shaded) during its combustion cycle.
Figure 8A:
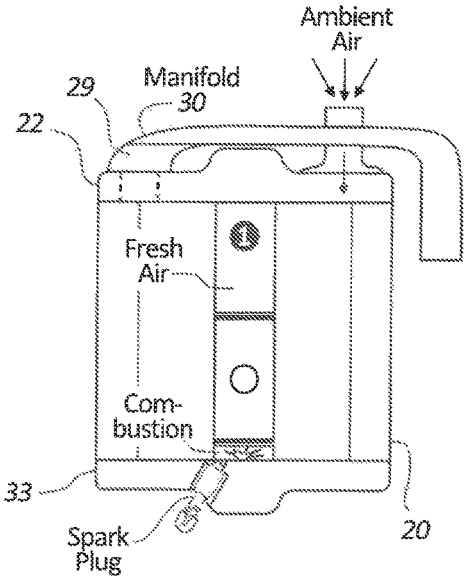

Referring now to FIGS. 8 and 8*a*, piston No. 1 is at top dead center with the compressed fuel-air mixture at the front of the piston and that portion of the cylinder to the rear of the piston is full of fresh ambient air. The spark phis ignites the fuel-air mixture at this top dead center position forcing the piston down the cylinder. As the piston moves through its cylinder the turning force created by the piston follower's engagement with the elliptical cam track 16 acts to rotate the rotor.

Figure 9:
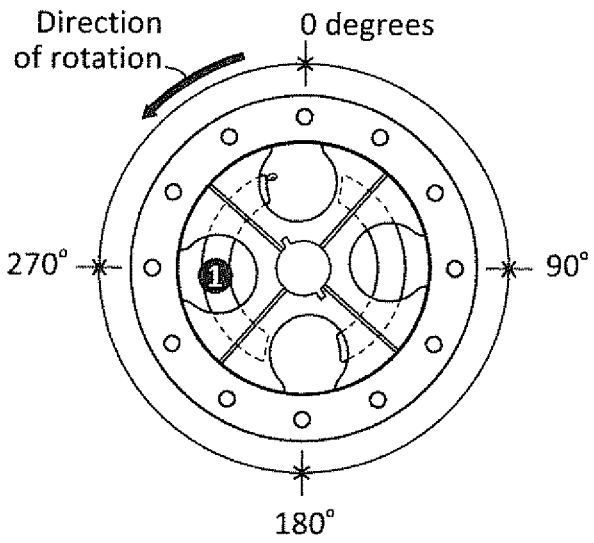
Figure 9A:
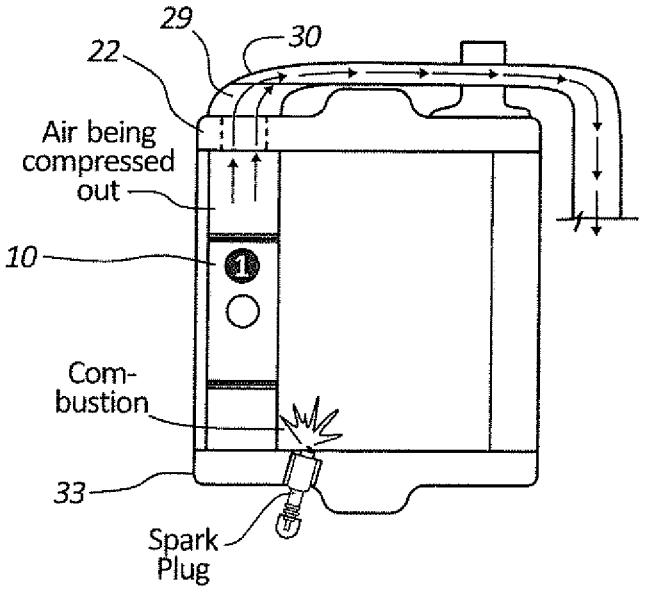

In FIGS. 9 and 9*a* the rotor, in response to the force created by the follower 17 and the cam track, has turned counterclockwise 90 degrees and piston No. 1 has simultaneously moved, by the force of the combustion, to a position half way through the length of the cylinder. Movement of the piston through the cylinder has compressed the fresh air behind the piston and as the piston reaches the 90 degree position the leading edge of the rear end of the cylinder has uncovered the compressed air discharge slot 28 in the rear end cap 22 which permits the transfer manifold to continue filing with compressed air.

Figure 10:
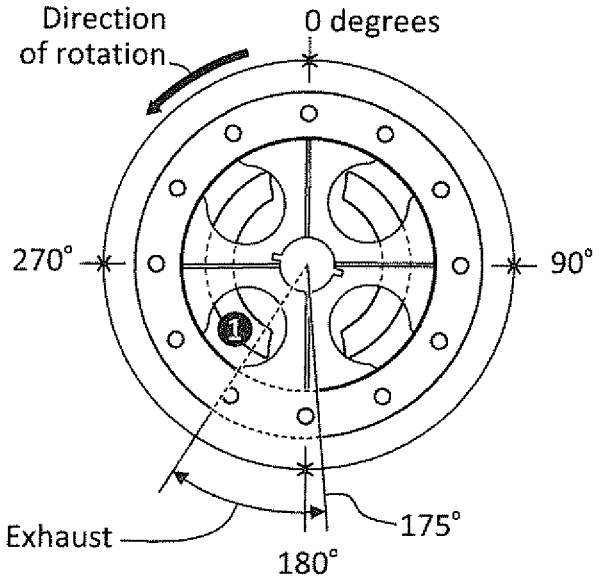
Figure 10A:
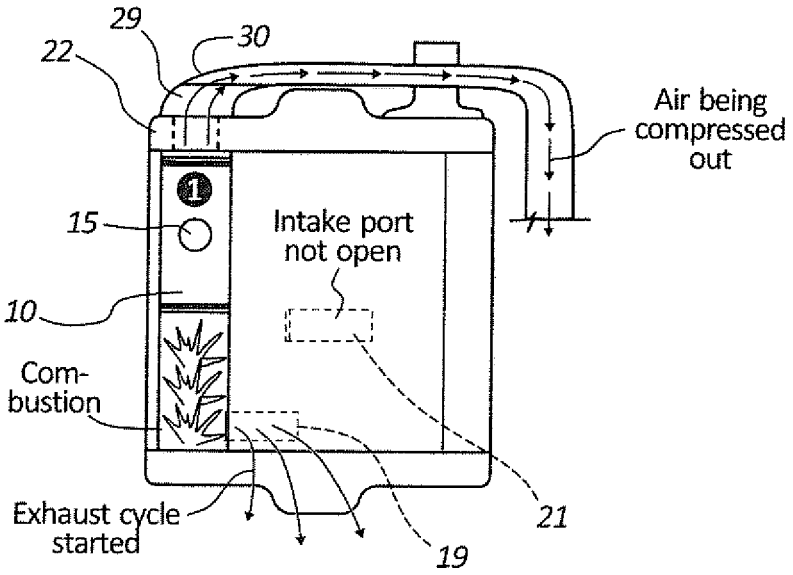

In FIGS. 10 and 10*a* the cylinder has moved to about 200 degrees with the rear end of the cylinder still allowing communication with the compressed air port to release compressed aft as the piston is nearing bottom dead center. The leading lengthwise edge of the cylinder is beginning to uncover the exhaust port 19, allowing the products of combustion to exit the housing 20.

Figure 11:
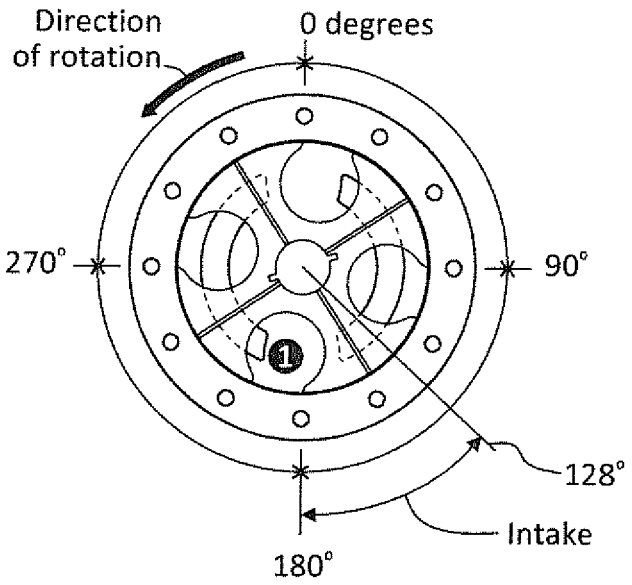
Figure 11A:
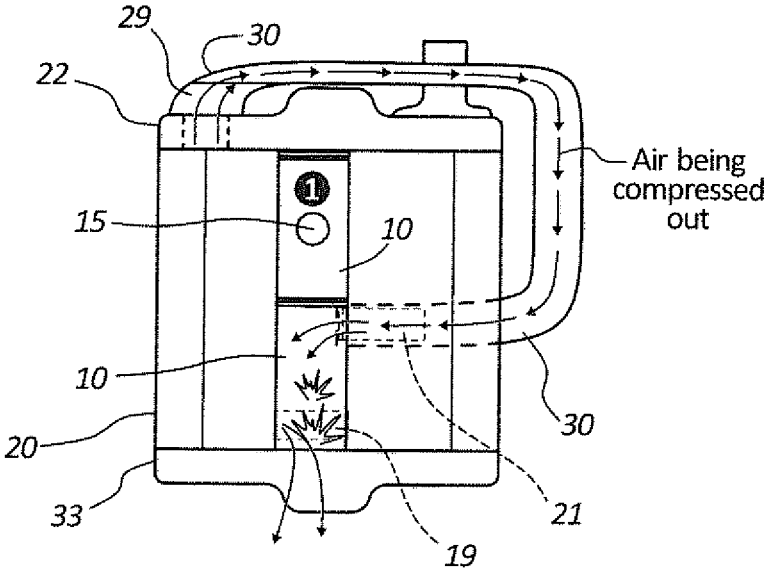

FIGS. 11 and 11*a* depict the piston's position just ahead of bottom dead center. The combustion cycle is very near completion. The leading longitudinal edge of the cylinder is beginning to uncover the intake transfer port 21 to admit the compressed air in the manifold 30 into the front of the cylinder ahead of piston No. 1. Simultaneously, the cylinder is beginning to cover and close the exhaust port 19. However, as shown in FIG. 11, there is an overlap in the opening of the intake transfer port and the dosing of the exhaust port that allows the incoming compressed air to drive the products of combustion out of the front of the cylinder.

Figure 12:
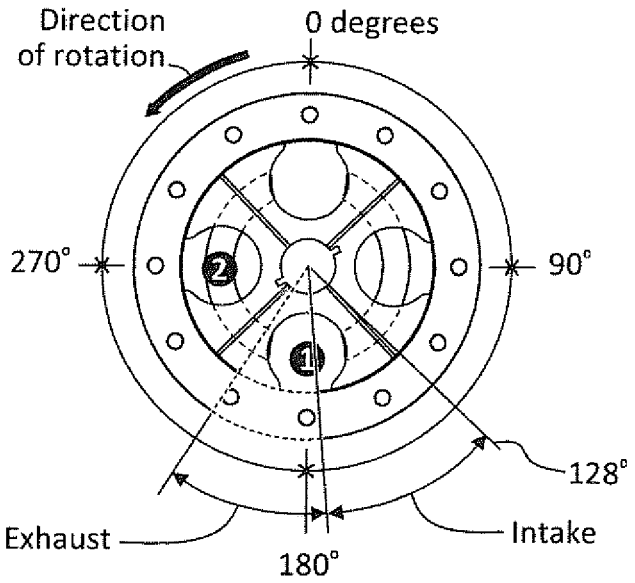
FIGS. 12-15 are diagrammatic front views of the four piston rotor of FIG. 7, tracing the position and combustion activity of a second piston, number 2, from 270 degrees through 180 degrees and the position of and activity of the inhaling air intake of piston No. 1 from 180 degrees to 90 degrees.
Figure 12A:
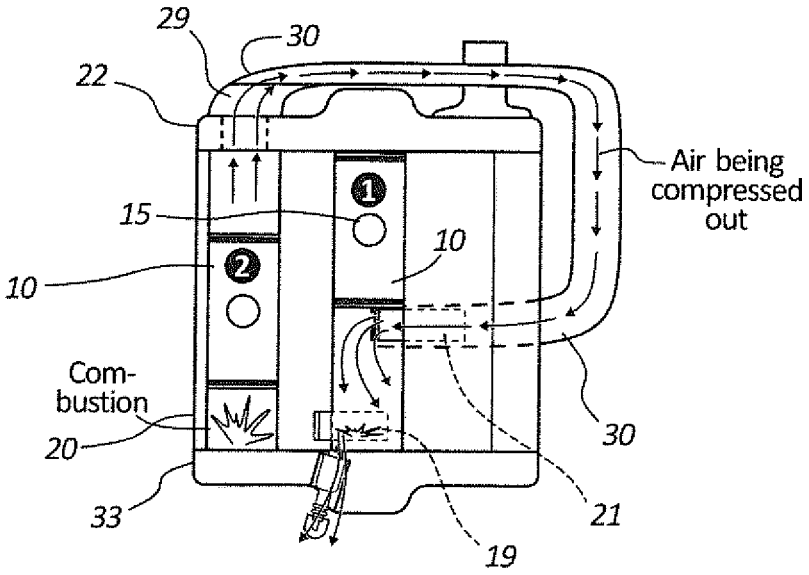

In FIGS. 12 and 12*a* piston No. 1 is at bottom dead center and the leading edge of its cylinder continues to uncover and open the intake transfer port 21 to admit compressed air into the front of the cylinder. The exhaust port 19 is still open allowing the products of combustion in front of piston No.1 to escape. The front of piston No. 2 is now in the combustion cycle while the rear of that piston is compressing fresh air and forcing it into the intake manifold 29 because the position of piston No. 2 permits compressed air slot 28 in the rear cap to be open and in communication with the rear of piston No. 2's cylinder.

Figure 13:
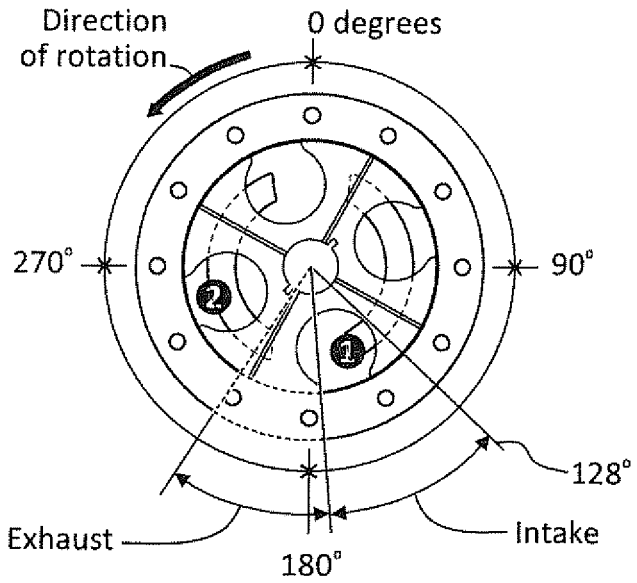
Figure 13A:
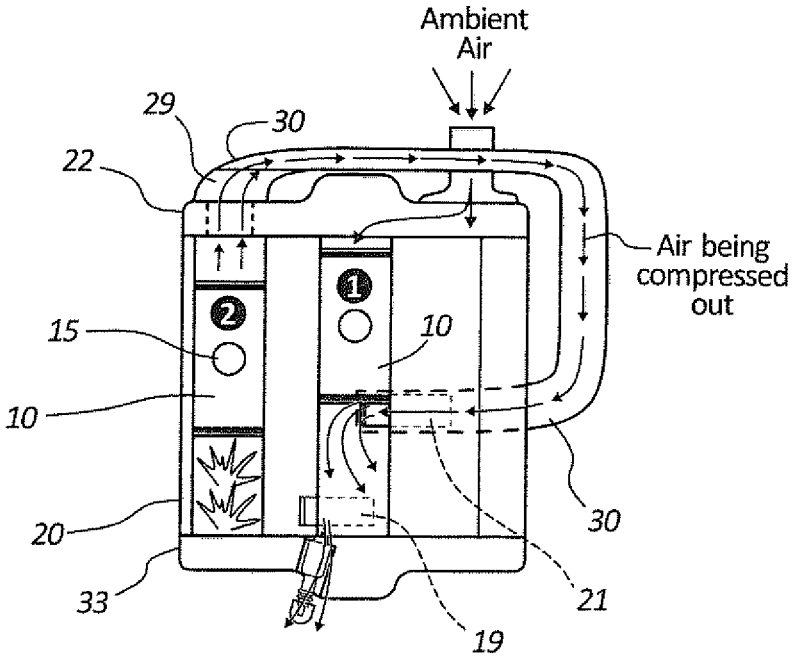

Examining FIGS. 13 and 13*a*, it is seen that cylinder No 1 has closed the exhaust port and piston No. 1 has started to move away from the rear cap, uncovering the air intake port 25 in the rear cap 22, thus allowing ambient air to be inhaled into the rear of cylinder No. 1. At the same time, cylinder No. 1 has rotated to a position in which the intake transfer port 21 is beginning to uncover, admitting compressed air into the front of cylinder No. 1 where it will be further compressed in anticipation of a subsequent detonation. In the same time frame, the front of piston No. 2 is still in the combustion cycle while the position of the of rear end of piston No.2 allows the compressed air port 28 to open and admit the fresh air that is being pushed out of the port by the rear of piston No. 2 and into the intake manifold 29 and the transfer manifold 30.

Figure 14:
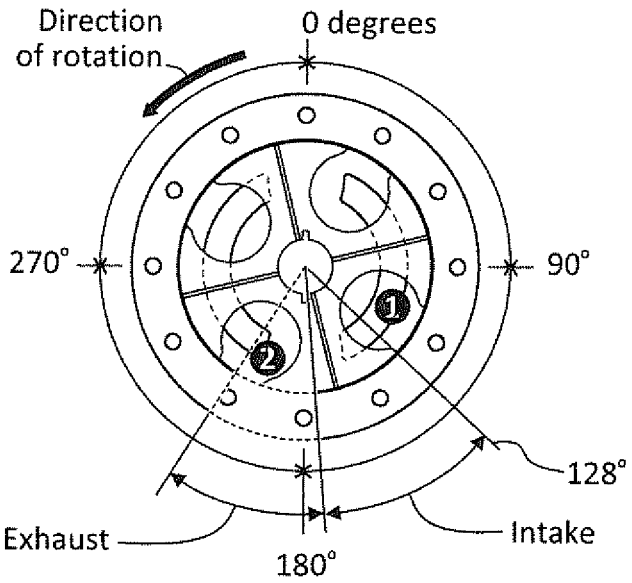
Figure 14A:
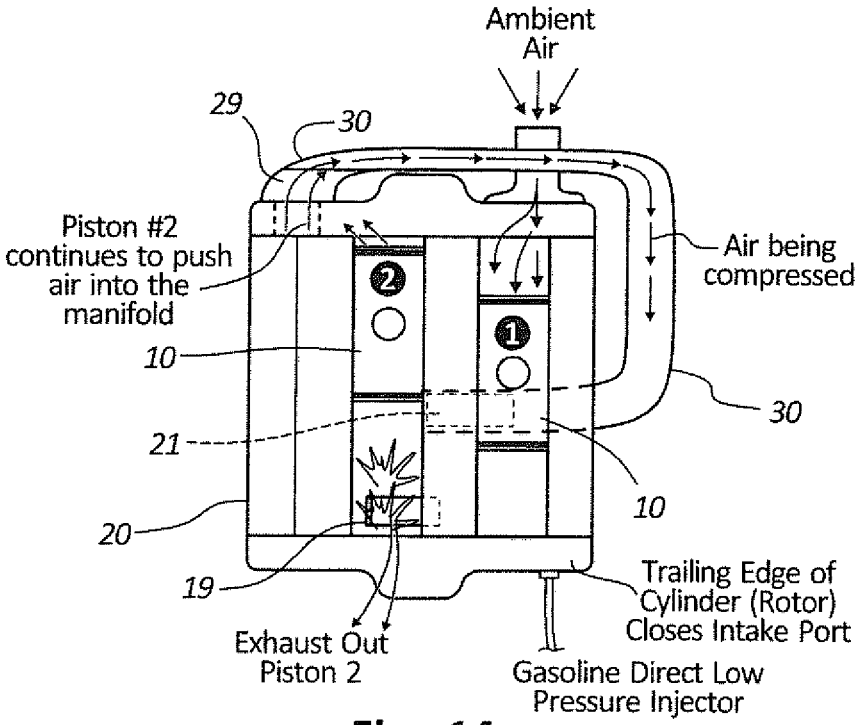

FIGS. 14 and 14*a* represent the rotor and pistons in a position 47 degrees from its position in FIGS. 13 and 13*a*. The trailing edge of cylinder No.1 has closed the intake transfer port 21 and the air in front of the piston is beginning to be compressed as the piston moves forward while inhaling air from the air intake port 25. Cylinder No. 2 has opened the exhaust port 19 to begin the exhaust process.

Figure 15:
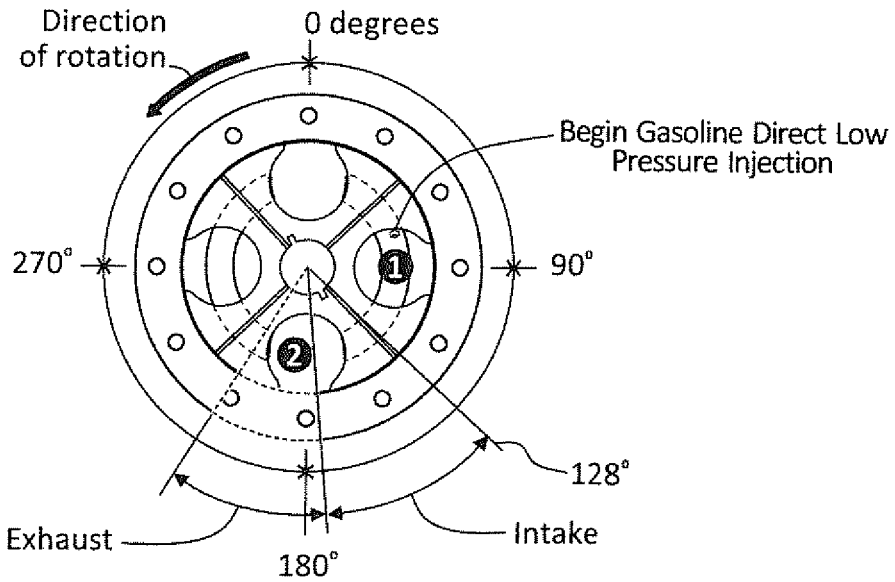
Figure 15A:
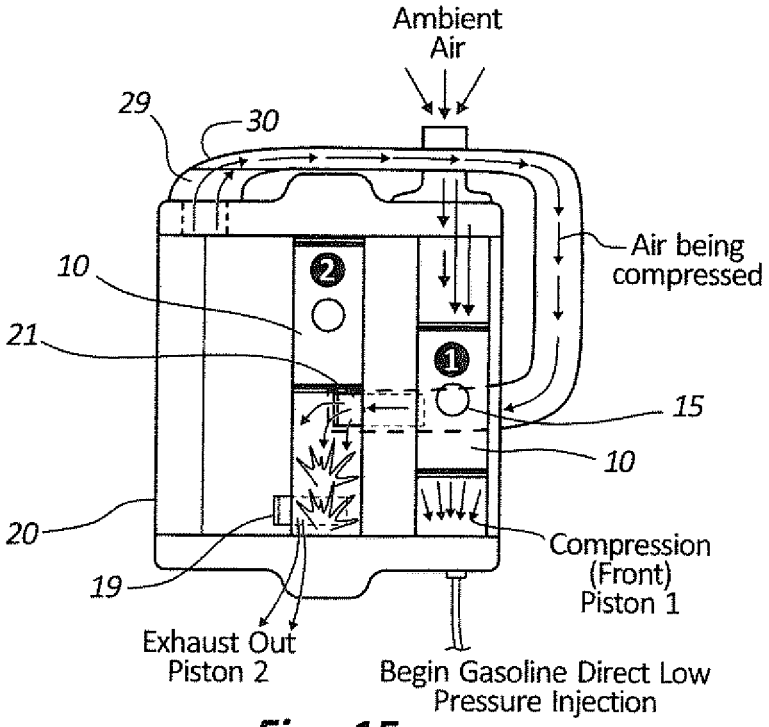

In FIGS. 15 and 15*a* piston No. 2 is at bottom dead center where the exhaust and transfer intake ports are both open for a small number of degrees of rotor rotation, as in FIGS. 12 and 12*a*, where the compressed air flows through the transfer intake port into the front of cylinder No. 2 to aid piston No. 2 is forcing the products of combustion out of exhaust port 19. FIG. 15*a* depicts the preferred position of the fuel injector 27.

I claim:

1. A rotary piston engine comprising:

a cylindrical rotor;

an output shaft axially extending through the cylindrical rotor;

a plurality of cylinders being mutually parallel to each other and to the output shaft;

wherein each of the plurality of cylinders comprises a longitudinally extending cylinder-forming bore disposed on a perimeter of the cylindrical rotor;

wherein said each of the plurality of cylinders has a front portion and a rear portion;

a plurality of slidable pistons;

wherein said each of the plurality of cylinders has one of the plurality of slidable pistons disposed therein; and an engine housing having a cylindrical interior encompassing the cylindrical rotor and further comprising:

means for admitting ambient air into the rear portion of the plurality of cylinders;

means for transferring compressed aft from the rear portion of the plurality of cylinders to the front portion of the plurality of cylinders in response to an angular position of the cylindrical rotor;

means for injecting fuel into the compressed aft in the front portion of the cylinders;

means for causing combustion of the fuel-air mixture in the front portion of the plurality of cylinders;

means for exhausting combustion gas from the front portion of the plurality of cylinders in response to the angular position of the cylindrical rotor; and means for engaging the plurality of slidable pistons to rotate the rotor in response to combustion of the fuel-air mixture in the front portion of the plurality of cylinders.

2. The rotary piston engine of claim 1, wherein the means for engaging the plurality of slidable pistons is an elliptical cam track channel routed in an inside wall of the engine housing.

3. The rotary piston engine of claim 2, further including a rear end cap attached to the engine housing and where the means for admitting ambient air into the rear portion of said each of the plurality of cylinders comprises an arcuate slot in the rear end cap.

4. The rotary piston engine of claim 3, wherein the means for transferring compressed air from the rear portion of the cylinders further comprises:

an additional arcuate slot in the rear end cap;

an intake manifold attached to the rear end cap and covering the additional arcuate slot; and an air transfer manifold and an air intake port disposed in the engine housing in a position to communicate with the front portions of said each of the plurality of cylinders.

5. The rotary piston engine of claim 4, further including a front end cap attached to the engine housing and where the means for causing combustion of the fuel-air mixture comprises at least one spark plug carried by the front end cap and in communication with the front portion of said each of the plurality of cylinders.

6. The rotary piston engine of claim 5, wherein the means for injecting fuel comprises a fuel injector carried by the front end cap and in communication with the front portion of said each of the plurality of cylinders.

7. The rotary piston engine of claim 1, wherein the means for exhausting combustion gas from the front portion of said each of the plurality of cylinders includes an exhaust port disposed in the engine housing in a position to communicate with the front portion of said each of the plurality of cylinders.

8. A rotary piston engine comprising:

a rotatable cylindrical rotor having a plurality of longitudinally extending cylinder-forming bores disposed on the perimeter of the cylindrical rotor which are mutually parallel to each other and to an output shaft axially extending through the cylindrical rotor;

slidable pistons;

wherein each of the plurality of longitudinally extending cylinder-forming bores has one of the slidable pistons disposed therein;

an engine housing encompassing the rotatable cylindrical rotor;

means interconnecting the engine housing and one of the slidable pistons for causing rotation of the rotatable cylindrical rotor;

wherein the engine housing includes a cylindrical interior surface;

wherein the means interconnecting the engine housing and one of the slidable pistons for causing rotation of the rotatable cylindrical rotor includes;

an elliptical cam track channel routed in the cylindrical interior wall surface of the engine housing; and a follower pin extending from one of the slidable pistons and slidingly engaged with the cam track channel.

9. A rotary piston engine comprising:

a rotatable cylindrical rotor having a plurality of longitudinally extending cylinder-forming bores disposed on the perimeter of the cylindrical rotor which are mutually parallel to each other and to an output shaft axially extending through the cylindrical rotor;

slidable pistons;

wherein each of the plurality of longitudinally extending cylinder-forming bores has one of the slidable pistons disposed therein;

an engine housing encompassing the rotatable cylindrical rotor;

means interconnecting the engine housing and one of the slidable pistons for causing rotation of the rotatable cylindrical rotor;

wherein said each of the plurality of longitudinally extending cylinder-forming bore include a front portion and a rear portion;

wherein the rotary piston engine further includes:

means for inhaling ambient aft into the rear portion of a first half of said each of the plurality of longitudinally extending cylinder-forming bore in response to sliding movement of one of the slidable pistons in the first half of said each of the plurality of longitudinally extending cylinder-forming bores toward the front portion of said each of the plurality of longitudinally extending cylinder-forming bores and an angular position of the rotatable cylindrical rotor;

means for injecting fuel;

means for causing combustion of fuel-air mixture; and means for exhausting combustion gas from the front portion of a second half of said each of the plurality of longitudinally extending cylinder-forming bores in response to sliding movement of one of the slidable pistons in the second half of said each of the plurality of longitudinally extending cylinder-forming bores toward the rear portion of said each of the plurality of longitudinally extending cylinder-forming bores and the angular position of the rotatable cylindrical rotor.

* * * * *